United States Patent [19]

Sawyer

[11] Patent Number: 4,864,660

[45] Date of Patent: Sep. 12, 1989

[54] FLEXIBLE HAND-CONFORMING PROTECTIVE GLOVE

[75] Inventor: Ralph D. Sawyer, Orleans, Mass.

[73] Assignee: R. Sawyer, Inc., West Harwich, Mass.

[21] Appl. No.: 215,647

[22] Filed: Jul. 6, 1988

[51] Int. Cl.[4] ..... A41D 19/00

[52] U.S. Cl. ..... 2/161 A; 2/161 R; 2/167

[58] Field of Search ..... 2/159, 160, 161 A, 167, 2/161 R

[56] References Cited

U.S. PATENT DOCUMENTS

| | | | |
|---|---|---|---|
| 2,653,601 | 9/1953 | Morrison | 2/167 |
| 2,728,082 | 12/1955 | Slimovitz | 2/167 |
| 2,873,450 | 2/1959 | Brodeur | 2/167 |
| 3,597,765 | 8/1971 | Stanton | 2/159 |
| 3,918,096 | 11/1975 | Lim | 2/161 A |
| 4,042,975 | 8/1977 | Elliott | 2/161 A |
| 4,095,292 | 6/1978 | Klein | 2/161 A |
| 4,525,877 | 7/1985 | Chong | 2/161 A |
| 4,561,122 | 12/1985 | Stanley | 2/167 |

*Primary Examiner*—Werner H. Schroeder
*Assistant Examiner*—D. Biefeld

[57] ABSTRACT

A flexible hand glove to whose multi-dimensionally stretchable back portion is attached a protective package to protect the back of the hand while still providing a hand-conforming fit during activity. The protective package is made from one or several layers of flexible, durable materials that offer abrasion and impact protection, and may be attached to the back portion of the glove with seams either coincident or not coincident with the seams joining the front and back portions of the glove.

11 Claims, 2 Drawing Sheets

FLEXIBLE HAND-CONFORMING PROTECTIVE GLOVE

BACKGROUND OF THE INVENTION

This invention relates to a glove that provides flexible protection for the back of the hand during instances, including athletic events and occupational situations, where the back of the hand and thumb may be subjected to abrasion or impact from hard surfaces or projectiles.

An individual's hand volume is based upon finger and hand length and thickness. Hand volume varies considerably among individuals, even among those who have the same standardized hand size used in glove fitting. Glove sizing, as with most other size-sensitive cut-and-sew products, including shoes, is based on dimensional averages. While there are conventions for shoe and glove length and width, finished shoes and gloves of the same size will still vary in length, width, and overall volume.

Traditionally, gloves covering all or any portions of the hand which were to closely fit the hand were constructed of thin leather such as cowhide or cabretta. Such gloves have been used in sports such as golf and baseball and in racquet sports to facilitate hand grip upon objects such as clubs, bats, and racquets. Close conformance of the glove to the hand is desired to prevent palm material bunching and hand flex restriction. To meet this need, and because of the aforementioned hand volume variations, gloves must be made in a manner that provides some degree of adjustable or flexible conformability. U.S. Pat. No. RE 31538 provides one solution through the use of elastic bands and velcro closures. Multi-dimensional stretch materials such as lycra, spandex, and nylon micromesh have also been used as glove back materials to ensure the required close fit.

In sports such as hockey and football, and in other performance applications, the hand may be subject to abrasion or impacts. Gloves made of or incorporating rigid and semi-rigid plastics, protective layers of leather, or stiff, closed-cell foams have been used to protect the hand in such applications.

SUMMARY OF THE INVENTION

In general, the invention features a flexible hand-conforming glove for the protection of the hand comprising a front glove portion joined to a back glove portion and a protective package affixed to the back glove portion. The protective package is affixed to a multi-dimensionally stretchable material. The protective package protects the back of the wearer s hand, particularly the knuckles, from abrasion and impacts, while at the same time providing a conformable and stretchable glove that does not unduly inhibit the wearer's performance.

In preferred embodiments, the protective package comprises one or more flexible, durable materials such as leather, textile, plastic, or foam and the multi-dimensionally stretchable material comprises lycra, spandex, or nylon micromesh. The protective package may additionally include a flexible substrate such as a foamed plastic between the flexible durable materials and the glove back portion.

In another preferred embodiment, the protective package includes a thumb protective package section affixed to a multi-dimensionally stretchable material of the back portion of the thumb stall portion of the glove. In a preferred embodiment, the protective package may be affixed to the back glove portion with stitching not coincident with the seams that join the front and back portions of the glove. This provides a glove with additional conformability and flexibility, especially with larger hands. In another embodiment, the invention provides a glove with a protective package affixed to the back glove portion along seams coincident with the seams joining the front and back glove portions.

Other advantages and features of the invention will be apparent from the following description of the preferred embodiments, and from the claims.

DESCRIPTION OF THE PREFERRED EMBODIMENTS

Figure 1:
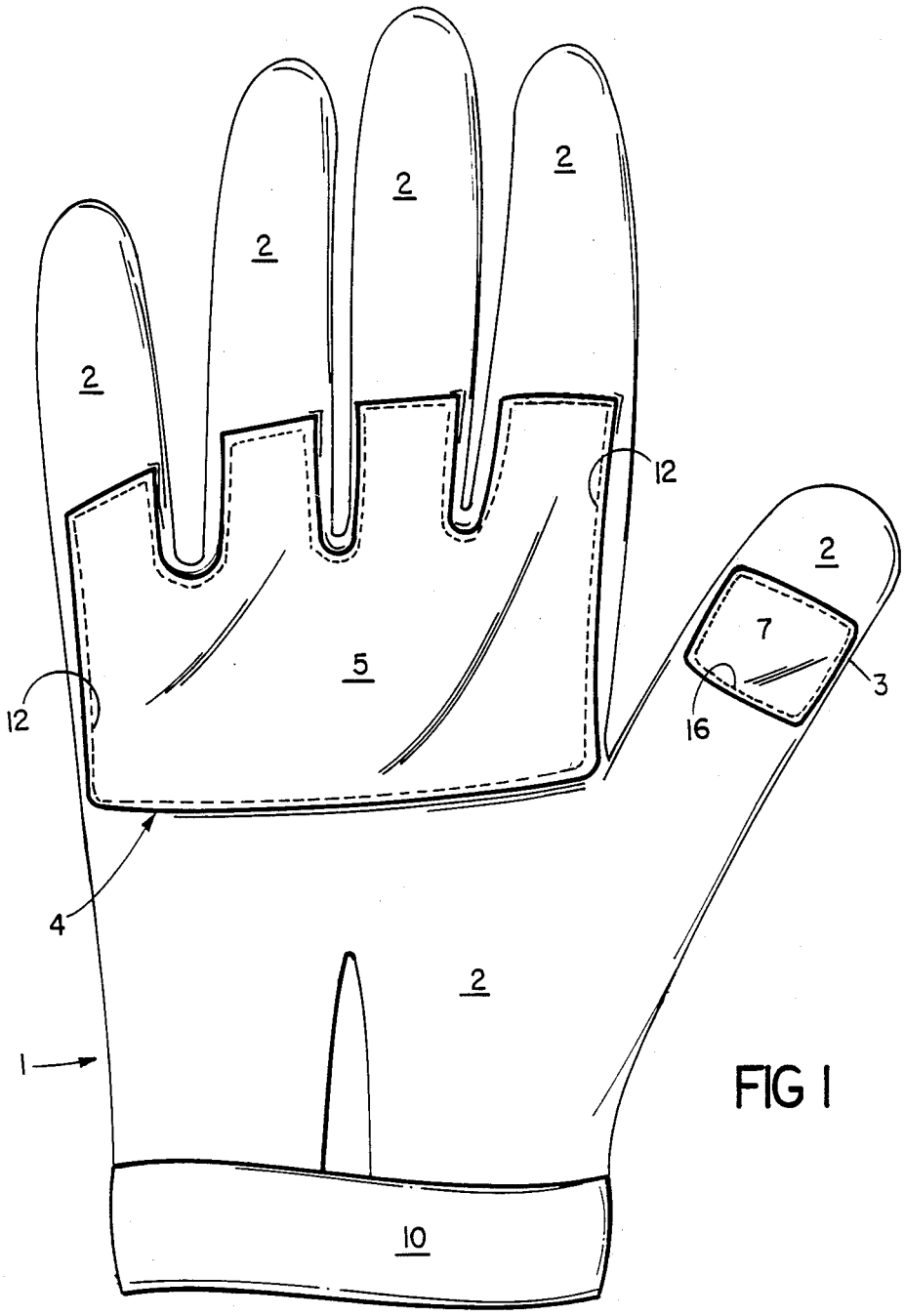
FIG. 1 shows the back portion of one embodiment of a glove with a protective package according to the invention.

Referring to FIG. 1, a left-handed glove, viewed from the back, has a back portion 1 that covers and protects the back of the hand. Nylon micromesh 2, a multi-dimensionally stretchable material, covers most of back portion 1 and underlies protective package 4. Back portion 1 is attached to a front glove portion (not shown) that protects the front/palm of the hand along seams (not shown). To micromesh nylon 2 is attached protective package 4, whose outermost layer 5 is made of cowhide, a durable, flexible material, FIGS. 1 and 2.

Figure 2:
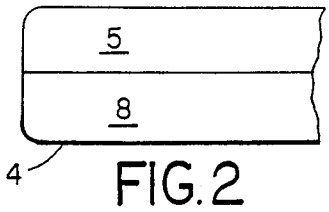
FIG. 2 is a cross-section of a protective package affixed to the back portion of a glove according to the invention.

FIG. 2 shows a cross-section of protective package 4 with cowhide 5 which has been prelaminated, prestitched, or otherwise prebonded to a layer of foam 8, a flexible substrate. Protective package 4 is affixed to back portion of the glove, FIG. 1, so that foam 8 is between cowhide 5 and nylon micromesh 2. In an alternate embodiment, foam 8 is not prebonded to cowhide 5. Instead, foam 8 is placed between nylon micromesh 2 and cowhide 5, and the edges of cowhide 5 are attached to nylon micromesh 2.

Figure 3:
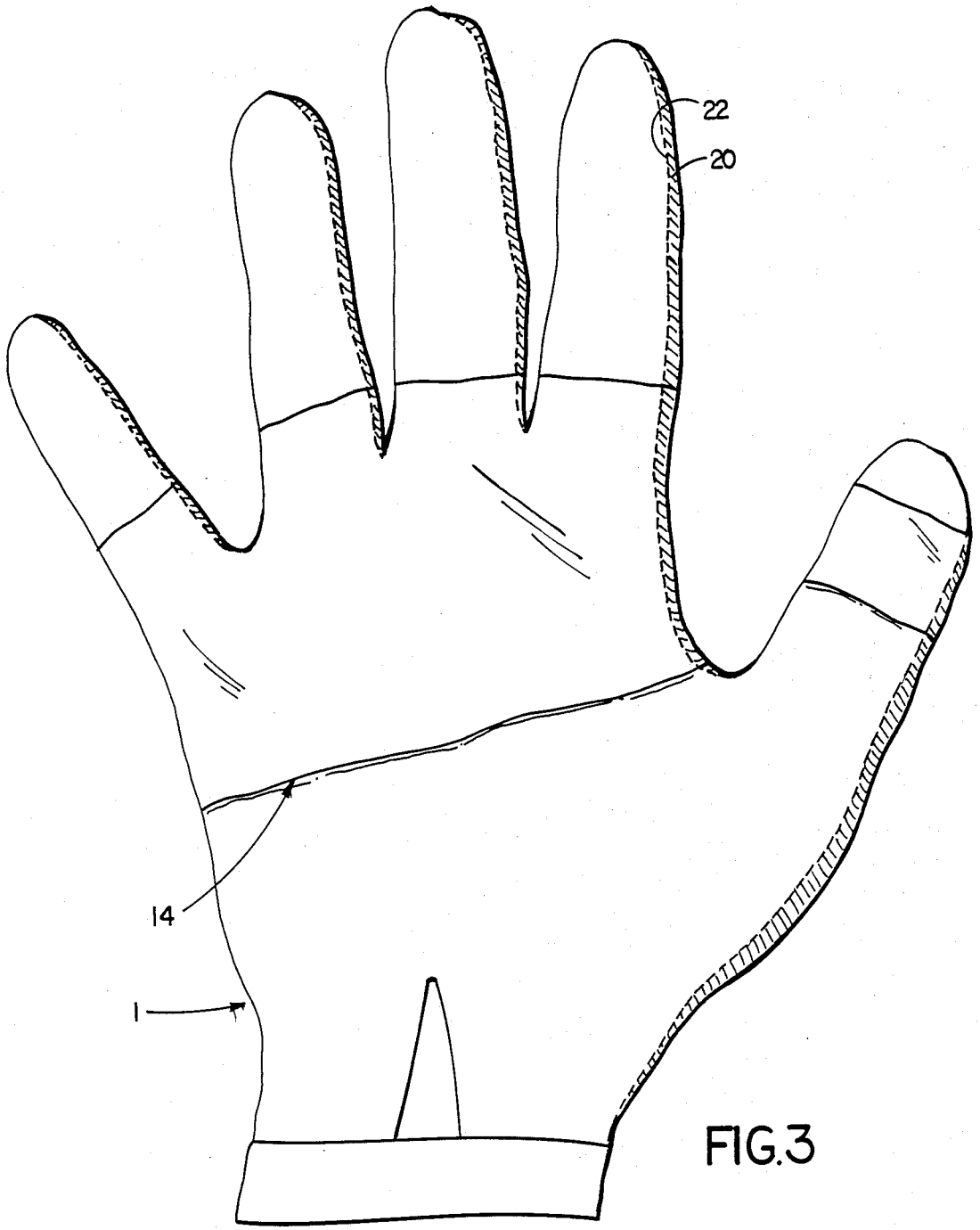

As shown in FIG. 1, the edges of protective package 4 are directly stitched to nylon micromesh 2 by edge stiches 12. Edge stitches 12 are separated from seams (not shown) which join back glove portion 1 to the front glove portion (not shown). This extra "border" of nylon micromesh between the seams and the edges of stitched-on protective packages allow for greater hand volume. In an alternate embodiment, FIG. 3 protective package 14 is affixed to back portion 1 through seams (22) that join back portion 1 to front portion (20), thus providing a glove that is easier to manufacture. In either embodiment, the back of the hand is protected while offering superior flexible glove performance. Multi-dimensionally stretchable nylon micromesh 2 on which the protective package is affixed expands and stretches as hand volume changes from one individual to another, and as any particular individual flexes his or her hand during activity. This volume and flexing are thus not constrained as they would be in the absence of a multi-dimensionally stretchable material to which the protective package is attached.

In a similar manner, the back of thumb stall 3 has a thumb protective package 7 attached to nylon micromesh 2. As shown in FIG. 1, thumb protective package 7 is stitched directly to nylon micromesh 2, providing borders between the seams (not shown) joining the front of the glove to its back (not shown) and the stitched edges 16 of thumb protective package 7.

The glove shown in FIG. 1 has wrist strap 10 for securing the glove to the hand. Other embodiments of the invention may include other means for ensuring a close fit such as velcro and elastic strips.

The glove depicted in FIG. 1 and FIG. 2 is merely one of many possible embodiments covered by the scope of the invention and the claims. Other multi-dimensionally stretchable materials, for example, lycra and spandex, may be used on the gloves' back portion. This material need not cover the entire back portion of the glove. For example, leather finger portions may be used for additional fingertip protection. In general, the stretchable material on the glove's back portion extends from the area between the first knuckle at the top of the fingers to close to the wrist area.

In different embodiments, the protective package may be comprised of one or more flexible, durable materials in any combination, and is not limited to cowhide. Other examples of such materials include, but are not limited to, polyurethane foam, vinyl sheet, and textiles. The protective package may or may not include a flexible substrate, depending upon the particular application. Other embodiments may include single or multiple layers or arrangements of flexible substrates such as leather, synthetic or polymeric foams, mid-density ethyl vinyl acetate, or other materials. Such substrate materials offer additional cushioning and protection to the back of the wearer's hand.

Protective package 4 need not be of the same composition as thumb protective package 7, nor need it be attached to the back of the thumb stall in the same manner and style as protective package 4. Depending upon the particular activity for which the glove is required, the relative sizes and areas of coverage of the protective package and the thumb protective package may vary. In some embodiments, the packages may cover merely the largest knuckles of the fingers and thumb, and in others, they may cover substantially all of the back of the hand. As well, a glove according to the invention need not include a thumb protective package on the glove's back portion.

The invention provides a glove that offers superior performance for athletic competitors. For example, such gloves may be made for use as batting gloves, racquetball gloves, football gloves, squash gloves, or handball gloves. As well, the present invention may be used in other action-oriented sports and activities such as the martial arts. In addition, mechanics and carpenters, and those who use wheelchairs, may also use a glove as disclosed and claimed for hand protection that does not restrict flexibility and motion.

I claim:

1. A flexible, hand-conforming glove for protecting the back of the hand from abrasion and impact, comprising:

a front glove portion covering the palm and the palm side of the thumb and fingers;

a back glove portion joined to the front glove portion covering the back of the hand, thumb, and fingers, said back glove portion comprising a multi-dimensionally stretchable material;

one or more flexible protective packages permanently affixed on an outwardly facing surface of the back glove portion so that the multi-dimensionally stretchable material can stretch beneath the protective package during use, said protective package comprising one or more flexible materials.

2. A glove as in claim 1 wherein the flexible materials comprise leather, textile, plastic, or foam.

3. A glove as in claim 2 wherein the leather is cowhide.

4. A glove as in claim 2, wherein the foam is polyurethane or mid-density ethyl vinyl acetate.

5. A glove as in claim 2, wherein the plastic is polyvinyl chloride.

6. A glove as in claim 1, wherein the multi-dimensionally stretchable material comprises lycra, spandex, or nylon micromesh.

7. A glove as in claim 1, wherein one of the protective packages is a thumb protective package permanently affixed on the outwardly facing surface of a back portion of a thumb stall of the glove.

8. A glove as in claim 1 wherein the protective package is affixed to the back glove portion coincident with seams joining the front glove portion to the back glove portion.

9. A glove as in claim 1 wherein the one or more protective packages are affixed to the back glove portion coincident with seams joining the front glove portion and the back glove portion.

10. A flexible, hand-conforming glove for protecting the back of the hand from abrasion and impact, comprising:

a front glove portion covering the palm and the palm side of the thumb and fingers;

a back glove portion joined to the front glove portion covering the back of the hand, thumb, and fingers, said back glove portion comprising a multi-dimensionally stretchable material;

one or more flexible protective packages permanently affixed on an outwardly facing surface of the back glove portion so that the multi-dimensionlly stretchable material can stretch beneath the protective package during use, the protective package affixed so that its edges are not coincident with seams at which the front and back glove portions are joined and maintaining borders of the multi-dimensionally stretchable material on all sides of the protective package, said protective package comprising one or more flexible materials.

11. A glove as in claim 10 wherein the flexible materials comprise foamed plastic and cowhide, the foamed plastic placed between the back glove portion and the cowhide, and the multi-dimensionally stretchable material is nylon micromesh.

* * * * *

UNITED STATES PATENT AND TRADEMARK OFFICE

CERTIFICATE OF CORRECTION

PATENT NO. : 4,864,660

DATED : September 12, 1989

INVENTOR(S) : Ralph D. Sawyer

It is certified that error appears in the above-identified patent and that said Letters Patent is hereby corrected as shown below:

Column 2, line 50: change "packages" to --package 4-- line 53: change "(22)" to --22-- and "(20)" to --20

Column 3, lines 37-38: change "required" to --geared--.

Signed and Sealed this

Twenty-fourth Day of September, 1991

*Attest:*

HARRY F. MANBECK, JR.

*Attesting Officer*

*Commissioner of Patents and Trademarks*